United States Patent [19]

McDaniel et al.

[11] Patent Number: 4,808,289

[45] Date of Patent: Feb. 28, 1989

[54] RESID HYDROTREATING WITH HIGH TEMPERATURE FLASH DRUM RECYCLE OIL

[75] Inventors: Norman K. McDaniel, Dickinson; Nicholas C. Vasti, Webster; Norman R. Woods, League City; Robert E. Boening, Galveston, all of Tex.

[73] Assignee: Amoco Corporation, Chicago, Ill.

[21] Appl. No.: 71,477

[22] Filed: Jul. 9, 1987

[51] Int. Cl.[4] ..... C01G 65/04

[52] U.S. Cl. ..... 208/210; 208/100; 208/102; 208/108; 208/112; 208/131; 208/155; 208/162; 208/212; 208/251 H; 208/254 H

[58] Field of Search ..... 208/50, 131, 89, 57, 208/59, 157, 210, 102, 100, 104, 108, 112, 95, 155, 162, 212, 251 H, 254 H

[56] References Cited

U.S. PATENT DOCUMENTS

| | | | |
|---|---|---|---|
| 3,375,189 | 3/1968 | Hamblin | 208/100 |
| 3,377,267 | 4/1968 | Spars | 208/100 |
| 3,471,397 | 10/1969 | Fortman | 208/100 |
| 3,844,937 | 10/1974 | Wolk | 208/162 |
| 3,972,803 | 8/1976 | Wolk et al. | 208/97 |
| 4,405,442 | 9/1983 | Deschamps et al. | 208/59 |
| 4,411,768 | 10/1983 | Unger et al. | 208/59 |
| 4,457,830 | 7/1984 | Kydd | 208/50 |
| 4,457,831 | 7/1984 | Gendler | 208/157 |
| 4,478,705 | 10/1984 | Ganguli | 208/59 |
| 4,521,295 | 6/1985 | Chervenak et al. | 208/59 |
| 4,713,221 | 12/1987 | Montgomery et al. | 208/57 |

*Primary Examiner*—Anthony McFarlane

*Attorney, Agent, or Firm*—Thomas W. Tolpin; William H. Magidson; Ralph C. Medhurst

[57] ABSTRACT

Resid hydrotreating conversion of resid can be substantially increased by blending the resid with high-temperature flash drum oil before being hydrotreated in a train of ebullated bed reactors. The high-temperature flash drum oil also improves the overall thermal efficiency of the process.

3 Claims, 3 Drawing Sheets

FRESH
CATALYST
46
10
LIQUID LEVEL
60
EXPANDED
CATALYST
BEDLEVEL
SETTLED
CATALYST
BED LEVEL
52
62
54
56
50
66
64
SPENT
CATALYST
WITHDRAWAL
48
58
PRODUCTS
OIL+H RICH GAS
REACTANTS:
RESID+ HT FLASH DRUM OIL+
H -RICH GASES
EBULLATING
PUMP

RESID HYDROTREATING WITH HIGH TEMPERATURE FLASH DRUM RECYCLE OIL

BACKGROUND OF THE INVENTION

This invention relates to resid hydrotreating and, more particularly, to a process for increasing the conversion of 1,000+°F. resid in a resid hydrotreating unit.

In the past, spiraling oil costs, extensive price fluctuations, and artificial output limitations by the cartel of oil producing countries (OPEC) have created instability and uncertainty for net oil consuming countries, such as the United States, to attain adequate supplies of high-quality, low-sulfur, petroleum crude oil (sweet crude) from Saudi Arabia, Nigeria, Norway, and other countries at reasonable prices for conversion into gasoline, fuel oil, and petrochemical feedstocks. In an effort to stabilize the supply and availability of crude oil at reasonable prices, Amoco Oil Company has developed, constructed, and commercialized extensive, multimillion dollar refinery projects under the Second Crude Replacement Program (CRP II) to process poorer quality, high-sulfur, petroleum crude oil (sour crude) and demetalate, desulfurize, and hydrocrack resid to produce high-value products, such as gasoline, distillates, catalytic cracker feed, metallurgical coke, and petrochemical feedstocks. The Crude Replacement Program is of great benefit to the oil-consuming nations by providing for the availability of adequate supplies of gasoline and other petroleum products at reasonable prices while protecting the downstream operations of refining companies.

During resid hydrotreating, such as under Amoco Company's Crude Replacement Program, resid oil (resid) is upgraded with hydrogen and a hydrotreating catalyst in a three-phase equilibrium of oil, catalyst, and gas bubbles to produce more valuable lower-boiling liquid products. In order to increase the efficiency, effectiveness, and profitability of resid hydrotreating, it is desirable to maximize the conversion of resid to more valuable lower-boiling liquid products.

Over the years, a variety of methods for processing resid with recycle oil have been suggested. Typifying some of the prior art methods for processing resid and other feedstocks with recycle oil are those found in U.S. Pat. Nos. 3,549,517; 3,681,231; 3,660,270; 4,457,831; and 4,411,768. Such prior art methods often use coke precursor absorption units to remove solids in the recycle oil or an extraction unit to remove propane or butane from the recycle oil. Such equipment can be expensive. Often prior art methods recycle some of the effluent directly from the reactor without removing light hydrocarbon gases or use vacuum oil. These prior art methods have met with varying degrees of success.

It is, therefore, desirable to provide an improved hydrotreating process for increasing the conversion of resid.

SUMMARY OF THE INVENTION

An improved hydrotreating process is provided to increase the conversion of resid (resid oil) in ebullated bed reactors (expanded bed reactors) to more valuable lower-boiling liquid products, such as naphtha (gasoline) and distillates (diesel fuel, kerosene), without increasing catalyst coke formation, downtime, and frequency of repair.

Advantageously, the novel hydrotreating process is efficient, effective, and economical. Desirably, the novel hydrotreating process improves product yield and increases profitability.

It was unexpectedly and surprisingly found that high temperature (HT) flash drum oil comprising gas oil and hydrotreated resid oil when recycled, injected, and blended with virgin, unhydrotreated resid oil feedstock significantly increased the conversion of the resid oil feedstock into more valuable liquid hydrocarbons in ebullated bed reactors. Desirably this was accomplished without the need for removing any solids from the HT flash drum oil or using additional processing equipment to upgrade the HT flash drum oil before it was recycled for use in the ebullated bed reactors. Advantageously, the HT flash drum oil also heats the resid oil feedstock to improve the overall thermal efficiency of the hydrotreating process so that the feedstock requires less heat (BTU) from heat exchangers and oil heaters.

A more detailed explanation of the process is provided in the following description and the appended claims taken in conjunction with the accompanying drawings.

DETAILED DESCRIPTION OF THE PREFERRED EMBODIMENT

Figure 2:
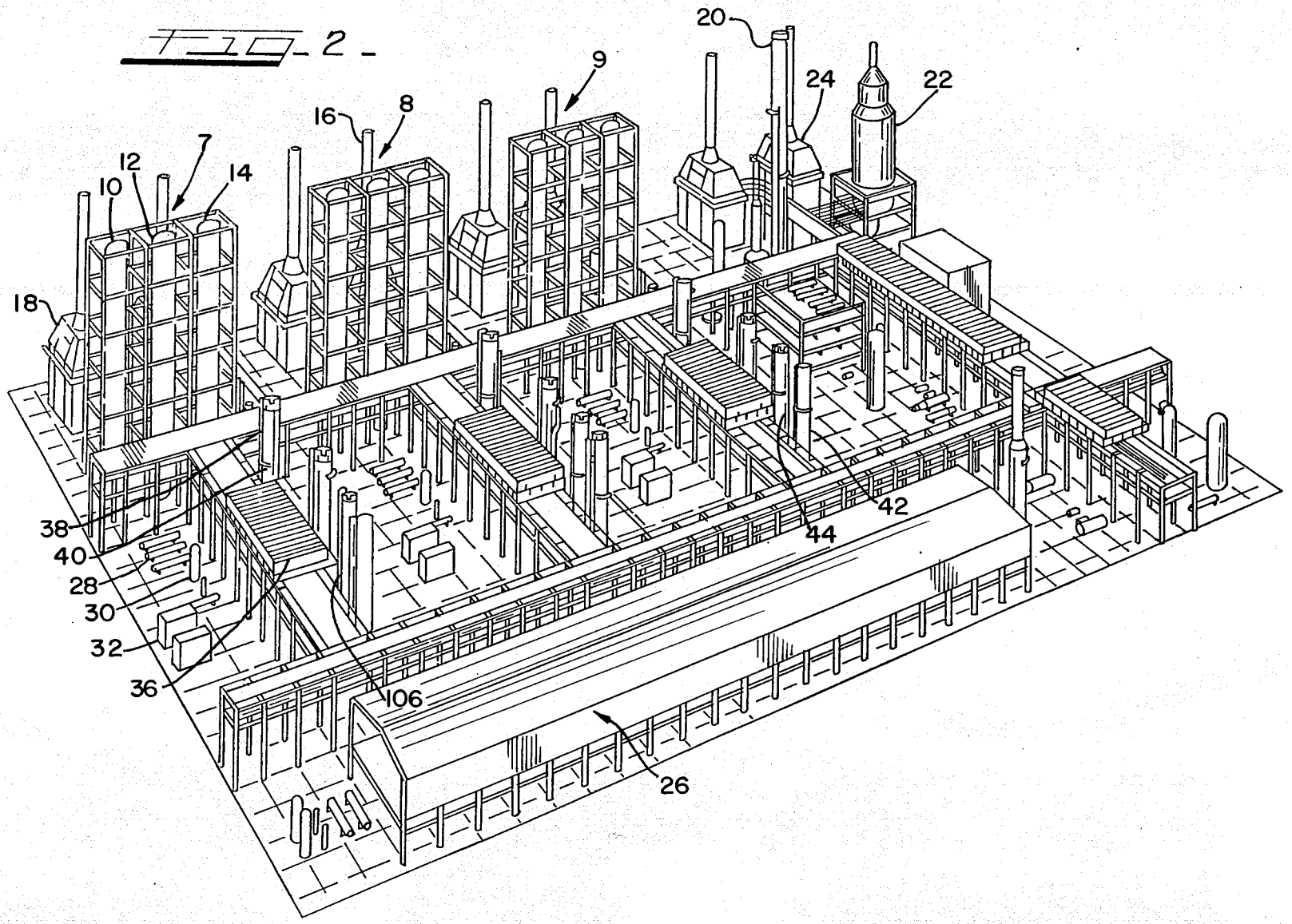
FIG. 2 is a perspective view of resid hydrotreating units and associated refinery equipment for carrying out the process.

Feed oil comprising high temperature (HT) flash drum recycle oil and high-sulfur resid oil feed, also referred to as sour crude or vacuum-reduced crude, comprising 1,000+°F. resid and heavy gas oil, is fed into resid hydrotreating units (RHU) 7, 8, 9 (FIG. 2) along with a hydrogen-rich feed gas. Each resid hydrotreating unit is a reactor train comprising a cascaded series or set of three ebullated (expanded) bed reactors 10, 12, and 14. In the reactors, the feed oil is hydroprocessed (hydrotreated) in the presence of fresh and/or equilibrium hydrotreating catalyst and hydrogen to produce an upgraded effluent product stream with reactor tail gases (effluent off gases) leaving used spent catalyst. Hydroprocessing in the RHU includes demetalation, desulfurization, denitrogenation, resid conversion, oxygen removal (deoxygenation), and removal of Rams carbon.

The resid hydrotreating units and associated refining equipment (FIG. 2) comprise three identical parallel trains of cascaded ebullated bed reactors 10, 12, and 14, as well as hydrogen heaters 16, influent oil heaters 18, an atmospheric tower 20, a vacuum tower 22, a vacuum tower oil heater 24, a hydrogen compression area 26, oil preheater exchangers 28, separators 30, recycled gas compressors 32, air coolers 36, raw oil surge drums 38, sponge oil flash drums 40, amine absorbers and recycle gas suction drums 42, and sponge oil absorbers and separators 44.

Each of the reactor trains comprises three ebullated bed reactors in series. The oil feed typically comprises resid oil (resid) and heavy gas oil. The feed gas comprises upgraded recycle gases and fresh makeup gases. Demetalation primarily occurs in the first ebullated bed reactor in each train. Desulfurization occurs throughout the ebullated bed reactors in each train. The effluent product stream typically comprises light hydrocarbon gases, hydrotreated naphtha, distillates, light and heavy gas oil, and unconverted hydrotreated resid. The hydrotreating catalyst typically comprises a hydrogenating component on a porous refractory, inorganic oxide support.

The resid hydrotreating unit is quite flexible and, if desired, the same catalyst can be fed to one or more of the reactors or a separate demetalation catalyst can be fed to the first reactor while a different catalyst can be fed to the second and/or third reactors. Alternatively, different catalysts can be fed to each of the reactors, if desired. The used spent catalyst typically contains nickel, sulfur, vanadium, and carbon (coke). Many tons of catalyst are transported into, out of, and replaced in the ebullated bed reactors daily.

Figure 3:
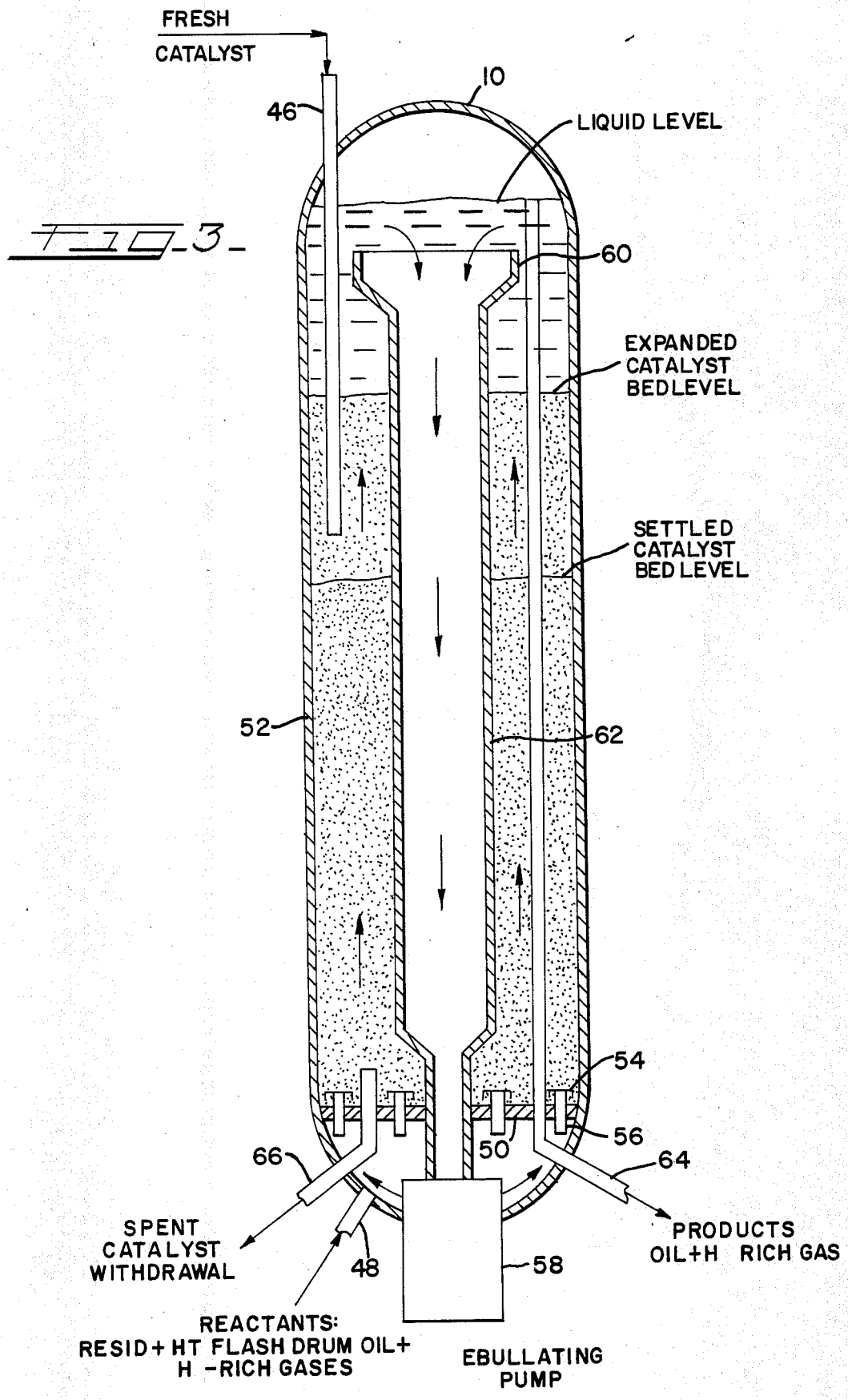
FIG. 3 is a cross-sectional view of an ebullated bed reactor.

As shown in FIG. 3, fresh hydrotreating catalyst is fed downwardly into the top of the first ebullated bed reactor 10 through the fresh catalyst feed line 46. Hot resid feed, HT flash drum oil, and hydrogen-containing feed gases enter the bottom of the first ebullated bed reactor 10 through feed line 48 and flow upwardly through a distributor plate 50 into the catalyst bed 52. The distributor plate contains numerous bubble caps 54 and risers 56 which help distribute the oil and the gas across the reactor and prevent catalyst from falling into the bottom section of the reactor. An ebullating pump 58 circulates and internally recycles oil from a recycle pan 60 through a downcomer 62 and the distributor plate 50. The rate is sufficient to lift and expand the catalyst bed from its initial settled level to its steady state expanded level. The effluent product stream of partially hydrotreated oil and hydrogen-rich reactor tail gases (off gases) is withdrawn from the reactor through effluent product line 64. The used spent catalyst is withdrawn from the bottom of the reactor through spent catalyst discharge line 66. The spent catalyst typically contains deposits of metals, such as nickel and vanadium, which have been removed from the influent feed oil (resid) during hydrotreating.

Catalyst particles are suspended in a three-phase mixture of catalyst, oil, and hydrogen-rich feed gas in the reaction zone of the reactor. Hydrogen-rich feed gas typically continually bubbles through the oil. The random ebullating motion of the catalyst particles results in a turbulent mixture of the phases which promotes good contact mixing and minimizes temperature gradients.

The cascading of the ebullated bed reactors in a series of three per reactor train, in which the effluent of one reactor serves as the feed to the next reactor, greatly improves the catalytic performance of the back-mixed ebullated bed process. Increasing the catalyst replacement rate increases the average catalyst activity.

Figure 1:
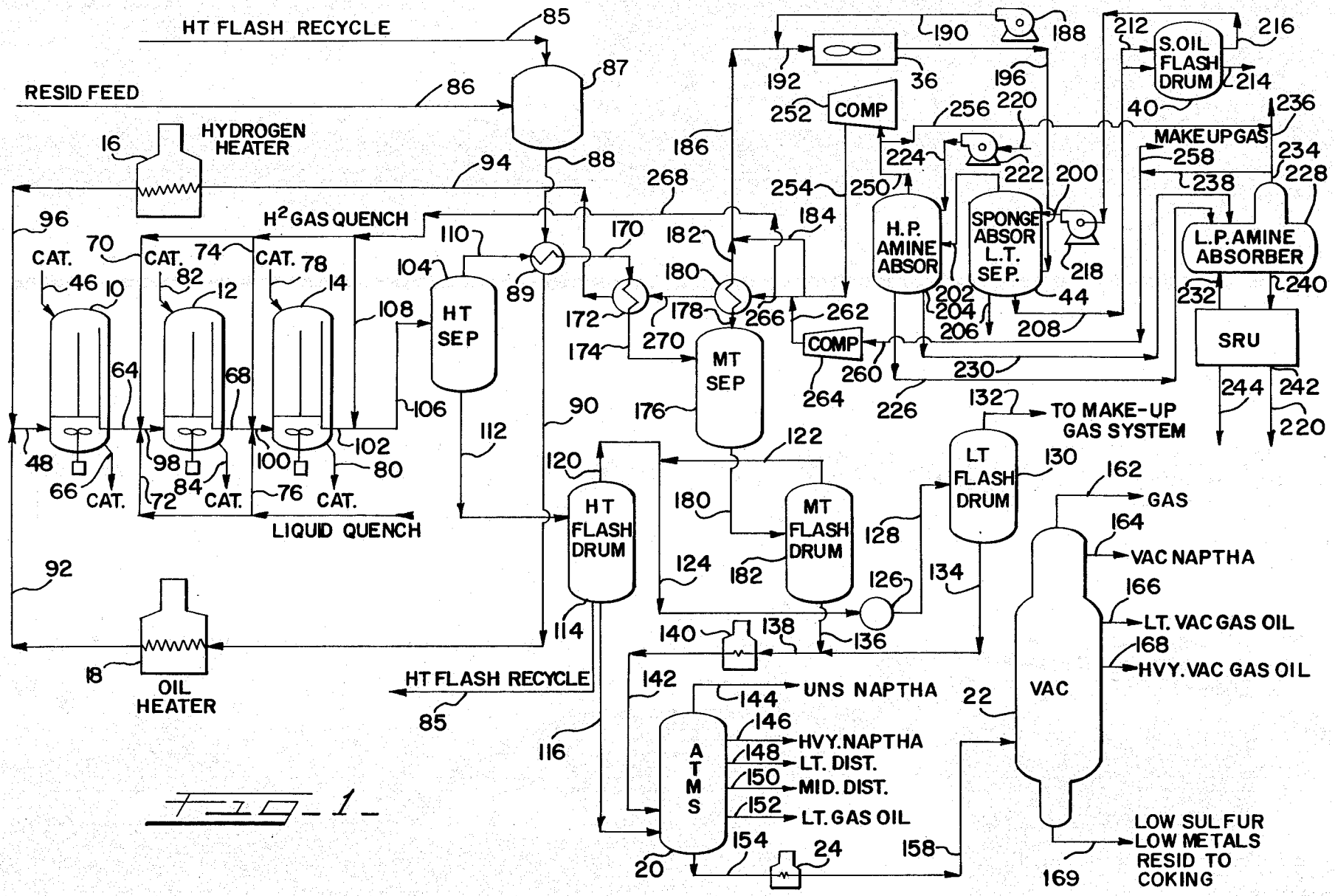
FIG. 1 is a schematic flow diagram of the hydrotreating process in accordance with principles of the present invention.

As shown in FIG. 1, the partially hydrotreated effluent in the outlet line 64 of the first ebullated bed reactor 10 comprises the influent feed of the second ebullated bed reactor 12. The partially hydrotreated effluent in the outline line 68 of the second ebullated bed reactor 12 is the influent feed of the third ebullated bed reactor 14. The second and third reactors are functionally, operatively, and structurally similar to the first reactor and cooperate with the first reactor to effectively hydrotreat and upgrade the influent feed oil. Quench liquid (oil) and/or hydrogen-containing gas can be injected into the influent feeds of the second and third reactors through quench lines 70, 72, 74 and 76 to cool and control the bulk temperatures in the second and third reactors. Fresh catalyst can be fed into the top of all the reactors, although for process efficiency and economy it is preferred to utilize catalyst staging by feeding fresh catalyst into the first and third reactors through fresh catalyst feed lines 46 and 78 and by feeding recycled spent catalyst from the third reactor into the second reactor through recycle catalyst lines 80 and 82. Used spent catalyst is discharged from the reactors 10 and 12 through spent catalyst discharge lines 66 and 84.

Preferably, the resid oil feedstock, which may be blended with some heavy gas oil as well as HT flash drum oil is heated in the oil heater 18, and the hydrogen-containing feed gas is heated in the hydrogen heater 16 before being combined and fed through the feed line 48 into the first reactor for process efficiency.

The fluid state of the ebullated hydrotreating catalyst enhances the flexibility of the ebullated bed reactors and permits the addition or withdrawal of oil/catalyst slurry without taking the reactors offstream. Daily catalyst replacement results in a steady state equilibrium catalyst activity.

Products are withdrawn from the third reactor 14 and are separated into fractions of oil and gas in the towers and other processing equipment as described hereinafter.

The ebullated bed reactors are capable of handling atmospheric and vacuum resids from a wide range of sour and/or heavy crudes. Such crudes can have a gravity as low as 5° API, a sulfur content up to 8% by weight, and substantial amounts of nickel and vanadium. The ebullated bed reactors typically operate at a temperature above 700° F. and at a hydrogen partial pressure greater than 1500 psi.

Ebullated bed reactors have many advantages over fixed bed reactors. They permit operation at higher average temperatures. They permit the addition and withdrawal of catalyst without necessitating shutdown. They avoid plugging due to dirty feed and formation of solids during resid conversion.

Since the liquid resid feed does not usually have enough velocity to expand the catalyst bed above its settled level, liquid is recycled from the top of the reactor to the bottom of the reactor through a downcomer pipe and then pumped back up through the reactor at a sufficient velocity to attain the required degree of expansion.

The products produced from the resid hydrotreating units in the ebullated bed reactors include light hydrocarbon gases, light naphtha, intermediate naphtha, heavy naphtha, light distillate, mid-distillate, light gas oil, vacuum naphtha, light vacuum gas oil, heavy vacuum gas oil, and hydrotreated vacuum resid. Light and intermediate naphthas can be sent to a vapor recovery unit for use as gasoline blending stocks and reformer feed. Heavy naphtha can be sent to the reformer to produce gasoline. The mid-distillate oil is useful for producing diesel fuel as well as for cooling the spent catalyst. Light and heavy vacuum gas oils and light gas oil are useful as feedstock for a catalytic cracker. The vacuum resid can be sent to cokers to produce coke.

As shown in FIG. 1, a high temperature (HT) flash drum recycle oil comprising hydrotreated resid oil and gas oil, in a high temperature flash recycle line 85 and a relatively high-sulfur nonhydrotreated, virgin resid oil feedstock in a resid feed line 86 are fed, injected, and mixed together in a feed drum or surge drum 87. The HT flash drum recycle oil preheats the virgin resid oil feedstock in the feed drum 87 to a temperature from about 450° F. to about 525° F. Preferably, the ratio of virgin resid oil feedstock to HT flash drum recycle oil in the feed oil ranges from about 3:1 to about 20:1 and most preferably about 4:1 to about 8:1 for best results. The feed oil comprising a mixture of HT flash drum recycle oil and virgin resid oil feedstock is passed through a combined, common feed oil line 88 and subsequently to a heat exchanger 89 where the feed oil mixture (nonhydrotreated virgin resid oil and HT flash drum recycle oil) is further preheated to a temperature from about 600° F. to about 650° F. The preheated feed oil mixture is conveyed through a preheated resid line 90 to an oil heater 18 where it is heated to a temperature ranging from about 675° F. to 750° F. The heated feed oil mixture is passed through a heated influent feed line 92 to an oil gas feed line 48.

Hydrogen-containing feed gas in the feed gas line 94 is fed into a hydrogen heater or feed gas heater 16 where it is heated to a temperature ranging from about 650° F. to about 900° F. The feed gas is a mixture of upgraded, methane-lean tail gases (effluent off gases) and hydrogen-rich, fresh makeup gases comprising at least about 95% by volume hydrogen and preferably at least about 96% by volume hydrogen. The feed gas comprises a substantial amount of hydrogen, a lesser amount of methane, and small amounts of ethane. The heated feed gas is conveyed through the heated feed gas line 96 to the gas oil feed line 48 where it is conveyed along with the heated resid oil to the first ebullated bed reactor.

Fresh hydrotreating catalyst is fed into the first ebullated bed reactor 10 through the fresh catalyst line 46. Spent catalyst is withdrawn from the first reactor through the spent catalyst line 66. In the first reactor, the feed oil is hydroprocessed (hydrotreated), ebullated, contacted, and mixed with the hydrogen-rich feed gas in the presence of the hydrotreating catalyst at a temperature of about 700° F. to about 850° F., at a pressure of about 2650 psia to about 3050 psia, and at a hydrogen partial pressure of about 1800 psia to about 2300 psia to produce a hydrotreated (hydroprocessed), upgraded, effluent product stream. The product stream is discharged from the first reactor through the first reactor discharge line 64 and conveyed through the second reactor feed line 98 into the second ebullated bed reactor 12. A liquid quench can be injected into the product feed entering the second reactor through a liquid quench line 72. The liquid quench can be sponge oil. A gas quench can be injected into the product feed before it enters the second reactor through a gas quench line 70. The gas quench preferably comprises a mixture of upgraded, methane-lean tail gases (effluent off gases) and fresh makeup gases.

Hydrotreating catalyst, which may be removed from the third reactor, is fed into the second reactor 12 through an influent catalyst line 82. Used spent catalyst is withdrawn from the second reactor through the second spent catalyst line 84. In the second reactor, the effluent resid oil product is hydroprocessed, hydrotreated, ebullated, contacted, and mixed with the hydrogen-rich feed gas and quench gas in the presence of the hydrotreating catalyst at a temperature of about 700° F. to about 850° F., at a pressure from about 2600 psia to about 3000 psia and at a hydrogen partial pressure of about 1700 psia to about 2100 psia to produce an upgraded effluent product stream. The product stream is discharged from the second reactor through a second reactor discharge line 68.

The product feed is then fed into the third ebullated bed reactor 14 through a third reactor feed line 100. A liquid quench can be injected into the third reactor feed through an inlet liquid quench line 76. The liquid quench can be sponge oil. A gas quench can be injected into the third reactor feed through an input gas quench line 74. The gas quench can comprise upgraded, methane-lean tail gases and fresh makeup gases. Fresh hydrotreating catalyst is fed into the third reactor through a fresh catalyst line 78. Used spent catalyst is withdrawn from the third reactor through the third reactor spent catalyst line 80. In the third reactor, the resid feed is hydroprocessed, hydrotreated, ebullated, contacted, and mixed with the hydrogen-rich gas in the presence of the hydrotreating catalyst at a temperature from about 700° F. to about 850° F., at a pressure of about 2550 psia to about 2950 psia and at a hydrogen partial pressure from about 1600 psia to about 2000 psia to produce an upgraded product stream. The product stream is withdrawn from the third reactor through the third reactor discharge line 102 and fed into a high-temperature, high-pressure separator 104 via inlet line 106. A gas quench can be injected into the product stream in the inlet line through a gas quench line 108 before the product stream enters the high-temperature separator. The gas quench can comprise upgraded, methane-lean tail gases and fresh makeup gases.

The upgraded effluent product streams discharged from the reactors comprise hydrotreated resid oil and reactor tail gases (effluent off gases). The tail gases comprise hydrogen, hydrogen sulfide, ammonia, water, methane, and other light hydrocarbon gases, such as ethane, propane, butane, and pentane.

In the high-temperature (HT) separator 104, the hydrotreated product stream is separated into a bottom stream of hydrotreated, high-temperature separator oil comprising heavy resid oil liquid and gas oil and an overhead stream of gases and hydrotreated oil vapors. The high-temperature separator is operated at a temperature of about 700° F. to about 850° F. and at a pressure from about 2500 psia to about 2900 psia. The overhead stream of gases and oil vapors is withdrawn from the high-temperature separator through an overhead line 110. The bottom stream of high-temperature separator oil liquid is discharged from the bottom of the high-temperature separator through a high-temperature separator bottom line 112 and fed to a high-temperature (HT) flash drum 114.

In the high-temperature flash drum 114, the influent stream of high-temperature separator oil liquid is separated and flashed into a flash stream of high-temperature oil vapors and gases and an effluent bottom stream of high-temperature (HT) flash drum oil comprising from about 50% to about 70% and preferably about 60% by weight gas oil and from about 30% to about 50% and preferably about 40% by weight hydrotreated heavy oil liquid. The HT flash drum 114 is operated at a temperature from about 770° F. to about 800° F. From about 5% to about 95%, preferably from about 20% to about 50%, and most preferably about 35% by weight of the HT flash drum oil is withdrawn from the bottom of the HT flash drum 114 through a high temperature (HT) flash drum recycle line 85 and conveyed, recycled, and used as part of the feed oil entering the train of ebullated bed reactors. A separate step or precursor unit for treating any solids in the HT drum recycle oil is not necessary. The other portion of the HT flash drum oil is discharged from the bottom of the flash drum 114 through a high-temperature (HT), flash drum bottom line 116 and fed into an atmospheric tower 20. The high-temperature flash gas and vapors are withdrawn from the high-temperature flash drum through a high-temperature, flash drum overhead line 120 and are conveyed, blended, and intermixed with medium-temperature overhead flash vapors from the mediumtemperature (MT) flash drum overhead line 122 through a combined, common flash line 124. The combined flash gas and vapors are optionally cooled in one or more heat exchangers or coolers 126 before being conveyed through a line 128 to the low temperature (LT) flash drum 130.

In the LT flash drum 130, the influent high-temperature flash gases and vapors are separated into low-pressure gases and light oil liquid. The low-pressure gases are withdrawn from the LT flash drum through an outlet gas line 132 and conveyed downstream to the makeup gas system for use as sweet fuel. The light oil liquid is discharged from the LT flash drum through a light oil line 134 and is conveyed, blended, and intermixed with medium-temperature (MT), light oil liquid from the medium-temperature, flash drum light oil line 136 in a combined, common light oil line 138. The combined medium-temperature, light oil liquid is heated in a furnace 140 and conveyed through a light oil feed line 142 to the atmospheric tower.

In the atmospheric tower 20, the HT flash drum oil from the high-temperature, flash drum effluent oil line 116 and the MT light oil liquid from the medium-temperature oil line 142 are separated into fractions of light and intermediate naphtha, heavy naphtha, light distillate, mid-distillate, light atmospheric gas oil, and atmospheric hydrotreated resid oil. Light and intermediate naphtha is withdrawn from the atmospheric tower through an unstable naphtha line 144. Heavy naphtha is withdrawn from the atmospheric tower through a heavy naphtha line 146. Light distillate is withdrawn from the atmospheric tower through a light distillate line 148. Mid-distillates are withdrawn from the atmospheric tower through a mid-distillate line 150. Light atmospheric gas oil is withdrawn from the atmospheric tower through a light atmospheric gas oil line 152. Atmospheric resid oil is discharged from the bottom portion of the atmospheric tower through the atmospheric resid line 154 and heated in an atmospheric resid oil heater 24 before being conveyed through a vacuum tower feed line 158 to the vacuum tower 22.

In vacuum tower 22, the atmospheric influent, hydrotreated resid oil is separated into gases, vacuum naphtha, light vacuum gas oil, heavy vacuum gas oil, and hydrotreated, vacuum resid oil or vacuum resid. The gases are withdrawn from the vacuum tower through an overhead vacuum gas line 162. Vacuum naphtha is withdrawn from the vacuum tower through a vacuum naphtha line 164. Light vacuum gas oil (LVGO) is withdrawn from the vacuum tower through a light vacuum gas oil line 166. Heavy vacuum gas oil (HVGO) is withdrawn from the vacuum tower through a heavy vacuum gas oil line 168. The entire stream of vacuum resid oil is withdrawn from the bottom of the vacuum tower through a vacuum resid discharge line 169 and fed to a coker (coke drum) or mixed with mid-distillate oil to produce low sulfur number 6 fuel oil.

Referring again to the high-temperature separator 104 (FIG. 1), high-temperature gases and oil vapors are withdrawn from the high-temperature separator 104 through an overhead vapor line 110 and cooled in a resid feed heat exchanger 88 which concurrently preheats the resid oil feed in line 86 before the resid oil feed enters the oil heater 18. The cooled vapors and gases exit the heat exchanger 88 and are passed through an intermediate line 170 and cooled in a high-temperature gas quench heat exchanger 174 which concurrently preheats the feed gas before the feed gas passes through the hydrogen heater inlet line 94 into the hydrogen heater 16. The cooled gases and vaposs exit the heat exchanger 172 and are passed through a medium-temperature inlet line 174 to a medium-temperature, high-pressure separator 176.

In the medium-temperature (MT) separator 176, the influent gases and oil vapors are separated at a temperature of about 500° F. and at a pressure of about 2450 psia to about 2850 psia into medium-temperature gases and hydrotreated, medium-temperature liquid. The medium-temperature gases are withdrawn from the MT separator through a medium-temperature gas line 178. The medium-temperature liquid is discharged from the bottom of the MT separator through a medium-temperature liquid line 180 and conveyed to a medium-temperature flash drum 182.

In the medium-temperature (MT) flash drum 182, the influent medium-temperature liquid is separated and flashed into medium-temperature vapors and effluent medium-temperature, hydrotreated liquid. The medium-temperature flash vapors are withdrawn from the MT flash drum through a medium-temperature overhead line 122 and injected, blended, and mixed with the high-temperature overhead flash gases and vapors in the combined, common flash line 124 before being cooled in heat exchanger 126 and conveyed to the LT flash drum 130. The effluent medium-temperature liquid is discharged from the MT flash drum through a light oil discharge line 136 and is injected, blended, and mixed with the low-temperature liquid from the LT flash drum in combined, common light oil liquid line 138 before being heated in the light oil heater 140 and conveyed to the atmospheric tower 20.

In the MT separator 176, the medium-temperature effluent gases exit the MT separator through an MT gas line 178 and are cooled in a medium-temperature (MT) feed gas heat exchanger 180 which also preheats the feed gas before the feed gas is subsequently heated in the HT heat exchanger 172 and the hydrogen heater 16. The cooled medium-temperature gases exit the MT heat exchanger 180 through a medium-temperature (MT) gas line 182 and are combined, blended and intermixed with compressed gas from an anti-surge line 184 in a combined, common gas line 186. The gas and vapors in gas line 186 are blended, diluted, and partially dissolved with wash water, pumped by the water pump 188 through a water line 190, in a combined water/gas inlet line 192. Ammonia and hydrogen sulfide in the tail gases react to form ammonium bisulfide which dissolves in the injected water. The gas and water products in line 192 are cooled in an air cooler 36 and conveyed through a sponge absorber feed line 196 into a sponge oil absorber and low-temperature (LT) separator 44.

Lean sponge oil is fed into the sponge oil absorber 198 through a lean sponge oil line 200. In the sponge oil absorber, the lean sponge oil and the influent tail gases are circulated in a countercurrent extraction flow pattern. The sponge oil absorbs, extracts, and separates a substantial amount of methane and ethane and most of the $C_3$, $C_4$, $C_5$, and $C_6+$ light hydrocarbons (propane, butane, pentane, hexane, etc.) from the influent product stream. The sponge oil absorber operates at a temperature of about 130° F. and at a pressure of about 2700 psia. The effluent gases comprising hydrogen, methane, ethane, and hydrogen sulfide are withdrawn from the sponge oil absorber through a sponge oil effluent gas line 202 and fed into a high-pressure (HP) amine absorber 204.

Effluent water containing ammonium bisulfide is discharged from the bottom of the sponge oil absorber 44 through an effluent water line 206 and conveyed to a sour water flash drum, a sour water degassing drum, and/or other wastewater purification equipment and recycled or discharged.

Rich sponge oil effluent containing $C_3$, $C_4$, $C_5$, and $C_6+$ absorbed light hydrocarbons is discharged from the bottom portion of the sponge absorber 44 through a rich sponge oil line 208 and conveyed to a sponge oil flash drum 40. Vacuum naphtha and/or middle distillate (mid-distillate oil) can also be fed into the sponge oil (SO) flash drum through a sponge oil-naphtha line 212 as a stream to keep a level in the sponge oil system. In the sponge oil flash drum 40, the rich sponge oil is flashed and separated into light hydrocarbon gases and lean sponge oil. The flashed light hydrocarbon gases are withdrawn from the SO flash drum through a gas line 214 and conveyed downstream for further processing. Lean sponge oil is discharged from the SO flash drum through a lean sponge oil discharge line 216 and pumped (recycled) back to the sponge oil absorber via sponge oil pump 218 and line 200. Some of the lean sponge oil can also be used as the liquid quench.

The ammonia-lean, $C_3+$ lean reactor tail gases containing hydrogen sulfide, hydrogen, methane, and residual amounts of ethane are fed into the high-pressure (HP) amine absorber 204 through an amine absorber inlet line 202. Lean amine from the sulfur recovery unit (SRU) lean amine discharge line 220 is pumped into the HP amine absorber 204 by a lean amine pump 222 through a lean amine inlet line 224. In the HP amine absorber 204, lean amine and influent tail gases are circulated in a countercurrent extraction flow pattern at a pressure of from about 2500 psia to about 2900 psia. The lean amine absorbs, separates, extracts, and removes substantially all the hydrogen sulfide from the influent tail gases.

Rich amine containing hydrogen sulfide is discharged from the bottom of the HP amine absorber 204 through a rich amine line 226 and conveyed to a low-pressure (LP) amine absorber 228. The lean amine from the sulfur recovery unit is recycled back to the high-pressure and low-pressure amine absorbers through the lean amine line. Skimmed oil recovered in the HP amine absorber 204 is discharged from the bottom of the HP amine absorber through a high-pressure (HP) skimmed oil line 230 and passed to the LP amine absorber 228. Lean amine from the sulfur recovery unit (SRU) 242 is also pumped into the LP amine absorber 228 through a LP lean amine inlet line 232.

In the LP amine absorber 228, the influent products are separated into gases, rich amine, and skimmed oil. Gases are withdrawn from the LP amine absorber 228 through a gas line 234 and conveyed downstream through line 236 for use as sweet fuel or added to the fresh makeup gas through auxiliary gas line 238. Rich amine is discharged from the LP amine absorber 228 through a rich amine discharge line 240 and conveyed to a sulfur recovery unit (SRU) 242, such as a Claus plant. Skimmed oil can also be withdrawn from the LP amine absorber and conveyed to the SRU through line 240 or a separate line. Sulfur recovered from the SRU is removed through sulfur recovery line 244.

In the HP amine absorber 204 of FIG. 1, the lean amine influent absorbs, separates, extracts and removes hydrogen sulfide from the influent stream leaving upgraded reactor tail gases (off gases). The upgraded reactor tail gases comprise about 70% to about 80% by volume hydrogen and about 20% to about 30% by volume methane, although residual amounts of ethane may be present. The upgraded reactor tail gases are withdrawn from the high-pressure amine absorber through an overhead, upgraded tail gas line 250 and conveyed to a recycle compressor 252. The recycle compressor increases the pressure of the upgraded tail gases. The compressed tail gases are discharged from the compressor through a compressor outlet line 254. Part of the compressed gases can be passed through an antisurge line 184 and injected into the combined gas line 186 to control the inventory, flow and surging of medium-temperature gases being conveyed to the sponge oil absorber 44. Other portions of the gases prior to compression can be bled off through a bleed line or spill line 256 and used for fuel gas or for other purposes as discussed below.

Fresh makeup gases comprising at least about 95% hydrogen, preferably at least 96% hydrogen by volume, from a hydrogen plant are conveyed through fresh makeup gas lines 258, 260, and 262 (FIG. 1) by a makeup gas compressor 264, along with gas from gas line 238, and injected, mixed, dispersed, and blended with the main portion of the compressed upgraded tail gases in a combined, common feed gas line 266. The ratio of fresh makeup gases to compressed recycle tail gases in the combined feed gas line 266 can range from about 1:2 to about 1:4.

About 10% by volume of the blended mixture of compressed, upgraded, recycled reactor tail gases (upgraded effluent off gases) and fresh makeup hydrogen gases in combined feed gas line 266 are bled off through a quench line 268 for use as quench gases. The quench gases are injected into the second and third ebullated bed reactors through the second reactor inlet quench line 70 and the third reactor inlet quench line 74 and are injected into the effluent hydrotreated product stream exiting the third reactor through quench line 108.

The remaining main portion, about 90% by volume, of the blended mixture of compressed, upgraded, recycled, reactor tail gases (upgraded off gases) and fresh makeup gases in the combined feed gas line 266 comprise the feed gases. The feed gases in the combined feed gas line 266 are preheated in a medium-temperature (MT) heat exchanger 180 (FIG. 1) and passed through a heat exchanger line 270 to a high-temperature (HT) heat exchanger 172 where the feed gases are further heated to a higher temperature. The heated feed gases are discharged from the HT heat exchanger 172 through a discharge line 94 and passed through a hydrogen heater 16 which heats the feed gases to a temperature ranging from about 650° F. to about 900° F. The heated hydrogen-rich feed gases exit the hydrogen heater 16 through a feed gas line 96 and are injected (fed) through an oil-gas line 48 into the first ebullated bed reactor.

It was unexpectedly and surprisingly found during extensive tests in the Amoco Oil Company Refinery at Texas City, Tex., that the conversion of the 1000+°F. resid (resid feed oil) to more valuable lower-boiling liquid products could be significantly and substantially increased without substantially increasing catalyst coke formation (coke deposition) or loss of product yield and quantity, by recycling, mixing, and blending recycle HT flash drum oil with the virgin (unhydrotreated) resid oil feedstock before the feed was fed into the train of ebullated bed reactors. This was accomplished without separately removing solids from the HT flash drum oil. The HT flash drum oil heated the resid oil feedstock, thereby, decreasnng the heat requirements of the heat exchangers and oil heaters upstream of the ebullated bed reactors.

EXAMPLE

Extensive testing was conducted at the Amoco Oil Company Refinery at Texas City, Tex., with a resid hydrotreating process similar to that shown in FIG. 1. The resid hydrotreating unit was tested with and without HT flash drum recycle oil. The results are indicated in Tables 1–4 below.

TABLE 1

| Train of Ebullated Bed Reactors | Feed Rate, MB/D | | | |
|---|---|---|---|---|
| | Resid | Gas Oil Diluent | HT Flash Drum Recycle Oil | Combined Feed |
| 200 | 16 | 0 | 8 | 24 |
| 300 | 24 | 0 | 0 | 24 |
| 400 | 16 | 8 | 0 | 24 |

TABLE 2

| Train | 1000+° F. Conversion Vol. % | Ramscarbon Removal Wt. % | Metals Removal Wt. % | Desulfurization Wt. % |
|---|---|---|---|---|
| 200 | 86.2 | 81.7 | 97.5 | 94.5 |
| 300 | 77.1 | 73.8 | 97.4 | 89.2 |
| 400 | 82.2 | 78.7 | 97.8 | 93.5 |

TABLE 3

The magnitude of the delta for recycle operation over diluent operation based on the parallel train tests are summarized below:
RECYCLE OPERATION LESS DILUENT OPERATION
(At Constant Total Reactor Charge Rate and Reactor Temperature)

| | Adjusted Parallel Train Tests |
|---|---|
| 1000+° F. Conversion, Vol. % | 7.0–7.3 |
| Ramscarbon Removal, Wt. % | 2.7–7.0 |
| Desulfurization, Wt. % | 2.3–3.2 |
| Metals Removal, Wt. % | 0.7–1.4 |

TABLE 4

The magnitude of the delta for recycle operation over pure resid (for the same total feed rate) based on the parallel train tests are summarized below:
RECYCLE OPERATION LESS PURE RESID OPERATION
(At Constant Total Reactor Charge Rate and Reactor Temperature)

| | Adjusted Parallel Train Tests |
|---|---|
| 1000+° F. Conversion, Vol. % | 7.6 |
| Ramscarbon Removal, Wt. % | 7.5 |
| Desulfurization, Wt. % | 3.0 |

TABLE 4-continued

The magnitude of the delta for recycle operation over pure resid (for the same total feed rate) based on the parallel train tests are summarized below:
RECYCLE OPERATION LESS PURE RESID OPERATION
(At Constant Total Reactor Charge Rate and Reactor Temperature)

| | Adjusted Parallel Train Tests |
|---|---|
| Metals Removal, Wt. % | 3.9 |

The RHU parallel train tests unexpectedly and surprisingly showed HT flash drum recycle oil to be substantially better than feed oil comprising virgin (unhydrotreated) resid with or without a gas oil diluent. Volume percent 1000+°F. conversion was observed to be about 7% higher with HT flash drum recycle oil versus gas oil diluent injection. This increase in conversion was observed for two test periods; the first with hot recycle on the 200 train and diluent on the 400 train, and the second with diluent on the 200 train and hot recycle on the 400 train. Hot recycle operation consistently outperformed diluent operation for Ramscarbon conversion, metals removal and desulfurization. Essentially, no increase in SHFT solids was attributed to hot HT flash drum recycle oil operation. A decrease in energy usage also favors HT flash drum recycle oil operation.

Among the many advantages of the resid hydrotreating process are:

1. Increased conversion of the 1000+°F. resid to more valuable, lower-boiling hydrocarbons.
2. Superior process efficiency.
3. Improved resid conversion effectiveness.
4. Increased product yield.
5. Maintains product quality.
6. Maintains operability with less asphaltenic solids.
7. Enhanced economy and profitability.
8. Improved Ramscarbon removal.
9. Improved desulfurizationand demetalation.
10. Increased production of more valuable liquid hydrocarbons.
11. Better thermal efficiency.

Although an embodiment of this invention has been shown and described, it is to be understood that various modifications and substitutions, as well as rearrangements and combinations of process steps and equipment, can be made by those skilled in the art without departing from the novel spirit and scope of this invention.

What is claimed is:

1. A hydrotreating process, comprising the steps of:

mixing recucled flash drum oil with nonhydrotreated virgin resid oil in a feed drum; while concurrently heating said nonhydrotreated virgin resid oil with said recycled flash drum oil;

feeding said feed oil comprising said nonhydrotreated virgin resind oil and said recycled flash drum oil to a reactor train comprising a series of ebullated bed reacctors, said recycled flash drum oil comprising by weight from about 50% to about 70% gas oiland from about 30% to about 50% hydrotreated heavy oil;

conveying a hydrotreating catalyst to said reactor train;

injecting feed gases comprising hydrogen and methane into said ebullated bed reactors;

ebullating and hydrotreating said feed oil with said feed gases in the presence of said hydrotreating catalyst at a hydrotreating temperature in said ebullated bed reactors to produce an upgraded product stream comprising hydrotreated resid oil and effluent tail gases comprising hydrogen, hydrogen sulfide, ammonia, water, and methane;

separating said product stream in a separator into an overhead stream of gases and oil vapors and a bottom stream of separator oil;

feeding a stream consisting essentially of separator oil to a flash drum;

flashing and separating said separator oil in said flash drum into a stream of gases and oil vapors and a bottom stream of flash drum oil;

fractionating and separating a portion of said flahs drum oil in an atmospheric tower into fractions of naphtha and atomospheric hydrotreated reside oil;

separating said atmospheric hydrotgreated resid oil in a vacuum tower into fractions of gases, gas oil, and vacuum resid; and recyling and passign another portion of said flash drum oil from said flash drum to said feed drum in the absence of previosuly separating and fractionating said recycled flash drum oil in said atmospheric tower and said vacuum tower 2. A hydrotreating process, comprising the steps of:

injecting, blending, and heating virgin nonhydrotreated resid oil feedstock with recycled oil from a flash drum in a feed drum to form a feed oil, said recycled oil from said flash drum comprising recycled flash drum oil, said rcycled flashdrum oil comprising from about 50% to about 70% by weight gas oil and from about 30% to about 50% by weight hydrotreated heavy oil;

feeding said feed oil and a feed gas comprising hydrogen to a reactor train comprising a series of three ebullated bed reactors;

conveying a hydrotreating catalyst to said rector train;

hydrotreating said feed oil with said feed gas in said reactors in the presence of said hydrotreating catalyst at a temperature ranging from about 700° F. to about 850° F. at a hydrogen partial pressure ranging from about 1500 psia to about 2400 psia to produce an upgraded product stream of hydrotreated rsid oil containing effluent reactor tail gases;

feeding said upgraded product stream to a separator;

separating said product stream in said separator into an overhead stream of gases and hydrotreated oil vapors and a bottom stream consisting essentially of separator oil;

conveying a stream consisting essentially of separator oil from said separator to a flash drum;

separating said separator oil into a stream of oil vapors and gas and a bottom stream of flsh drum oil comprising gas oil and hydrotreated resid oil;

passing a portion of said flash drum oil from said flash drum to an atmospheric tower;

fractionating and separating said portion of said flash drum oil in said atmospheric tower into a stream of naphtha, a stream of atmospheric gas oil, and a stream of atmospheric resid oil;

passing said atmospheric resid oil from said atmospheric tower to a vacuum tower;

separating said atmospheric resid oil in said vacuum tower into an overhead stream of vacuum gases, a stream of vacuum naphtha, a stream of vacuum gas oil, and a bottom stream of vacuum rsid oil;

withdrawing from about 5% to about 95% by weight of said bottom stream of flash drum oil from said flash drum, feeding said withdrawn flash drum to said feed drum at a ratio ranging from about 3:1 to about 20:1 to said resid oil feedstock, said about 5% to said about 95% by weight of said bottom stream of flash drum oil comprising said recycled flash drum oil.

3. A hydrotreating process in accordance with claim 2 wherein from about 20% to about 50% by weight of said bottom stream of flash drum oil is withdrawn from said flash drum for use as part of said feed oil, said about 20% to said about 50% by weight of said bottom stream of flash drum oil comprising said recycled flash drum oil, and said virgin nonhydro-treated resid oil is heated with said recycled flash drum oil in said feed drum to a temperature ranging from about 450° F. to about 525° F. before said resid oil and said recycled flash drum oil are fed to said reactor train.

* * * * *

UNITED STATES PATENT OFFICE
CERTIFICATE OF CORRECTION

Patent No. 4,808,289 Dated February 28, 1989

Inventor(s) Norman K. McDaniel, Nicholas Charles Vasti, Norman R. Woods, and Robert E. Boening

It is certified that error appears in the above-identified patent and that said Letters Patent is hereby corrected as shown below:

| PATENT Column | Line | |
|---|---|---|
| 7 | 9 | "mediumtemperature" should read --medium-temperature-- |
| 8 | 11 | "vaposs" should read --vapors-- |
| 11 | 12 | "decreasnng" should read --decreasing-- |
| 12 | 52 | "recucled" should read --recycled-- |
| 12 | 57 | "resind" should read --resid-- |
| 12 | 59 | "reacctors" should read --reactors-- |
| 12 | 60 | "oiland" should read --oil and-- |
| 13 | 14 | "flahs" should read --flash-- |
| 13 | 16 | "atomospheric" should read --atmospheric-- |
| 13 | 16 | "reside" should read --resid-- |
| 13 | 17 | "hydrotgreated" should read --hydrotreated-- |
| 13 | 20 | "passign" should read --passing-- |
| 13 | 24 | "tower" should read --tower.-- |
| 13 | 30 | "rcycled" should read --recycled-- |
| 13 | 30 | "flashdrum" should read --flash drum-- |
| 14 | 1 | "rsid" should read --resid-- |
| 14 | 11 | "flsh" should read --flash-- |
| 14 | 24 | "rsid" should read --resid-- |
| 14 | 39 | "nonhydro-treated" should read --nonhydrotreated-- |

Signed and Sealed this

Seventeenth Day of July, 1990

*Attest:*

*Attesting Officer*

HARRY F. MANBECK, JR.

*Commissioner of Patents and Trademarks*